US006235341B1

(12) United States Patent
Hino

(10) Patent No.: US 6,235,341 B1
(45) **Date of Patent: *May 22, 2001**

(54) METHOD OF PREPARING A HIGH FREQUENCY DIELECTRIC FILTER DEVICE USING SCREEN PRINTING

(75) Inventor: Seigo Hino, Nagoya (JP)

(73) Assignee: NGK Spark Plug Co., Ltd., Aichi-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/825,589

(22) Filed: Apr. 1, 1997

Related U.S. Application Data

(63) Continuation of application No. 08/492,517, filed on Jun. 20, 1995, now abandoned.

(30) Foreign Application Priority Data

Jun. 21, 1994 (JP) ..... 6-163189

(51) Int. Cl.[7] ..... B05D 5/12; B05D 1/32; H01P 1/202

(52) U.S. Cl. ..... 427/126.2; 427/282; 333/206

(58) Field of Search ..... 333/202, 203, 333/206, 207, 202 DB; 427/126.2, 282

(56) References Cited

U.S. PATENT DOCUMENTS

| | | | | |
|---|---|---|---|---|
| 4,800,348 | * | 1/1989 | Rosar et al. | 333/206 |
| 4,837,534 | * | 6/1989 | Van Horn | 333/223 X |
| 4,965,537 | * | 10/1990 | Kommrusch | 333/202 |
| 5,202,654 | * | 4/1993 | Heine | 333/202 X |
| 5,436,602 | * | 7/1995 | McVeety et al. | 333/207 X |
| 5,821,835 | * | 10/1998 | Hino | 333/202 |
| 5,844,454 | * | 12/1998 | Ono et al. | 333/206 |
| 5,949,308 | * | 9/1999 | Hino | 333/202 |

FOREIGN PATENT DOCUMENTS

| | | | | |
|---|---|---|---|---|
| 614244 | * | 9/1994 | (EP) | 333/206 |
| 58-204601A2 | | 11/1983 | (JP) . | |
| 62-163401A2 | | 7/1987 | (JP) . | |
| 3124102A2 | | 5/1991 | (JP) . | |
| 3-105004 | | 10/1991 | (JP) . | |
| 4-61903 | | 5/1992 | (JP) . | |
| 4-126404 | | 11/1992 | (JP) . | |
| 05095202 | | 4/1993 | (JP) . | |
| 5-145302 | * | 6/1993 | (JP) | 333/206 |
| 05291802 | | 11/1993 | (JP) . | |
| 06140803 | | 5/1994 | (JP) . | |
| 07066607 | | 3/1995 | (JP) . | |

* cited by examiner

*Primary Examiner*—Robert Pascal
*Assistant Examiner*—Barbara Summons
(74) *Attorney, Agent, or Firm*—Larson & Taylor PLC

(57) ABSTRACT

A high frequency dielectric filter device having a plurality of coaxial dielectric resonators arranged in parallel with each other wherein a portion having no conductor layer is formed on an outer peripheral surface close to a short-circuit end surface of a dielectric substrate in the direction diagonal to through-holes for the dielectric resonators, thereby easily and simultaneously obtaining polarization and coupling between the coaxial dielectric resonators with each other, that is, obtaining inter-stage coupling and an attenuation pole in the high band side of a center frequency.

1 Claim, 6 Drawing Sheets

METHOD OF PREPARING A HIGH FREQUENCY DIELECTRIC FILTER DEVICE USING SCREEN PRINTING

This application is a continuation of application Ser. No. 08/492,517 filed Jun. 20, 1995, now abandoned.

BACKGROUND OF THE INVENTION

The present invention relates to a high frequency dielectric filter device having a plurality of coaxial dielectric resonators arranged in parallel with each other.

There have been proposed various high frequency dielectric filter devices in which a dielectric substrate is provided with a plurality of through-holes which are formed in parallel with each other, each of the through-holes has a conductor layer arranged on its inner surface, and the dielectric substrate has an outer surface provided with an outer conductor which is connected with the inner conductor layers of the through-holes on one end surface of the dielectric substrate thereby to form a short-circuit surface, while the other end surface of the dielectric substrate is used as an open-circuit end surface. The high frequency dielectric filter devices having such an arrangement as stated above are used as a filter for a high frequency band. In this structure, a coaxial dielectric resonator is provided for each through-hole and thus a plurality of such resonators are arranged in parallel with each other.

An example of such conventional high frequency dielectric filter is shown in FIG. 1 of the accompanying drawings in which a dielectric substrate A is provided with two coaxial dielectric resonators B which are juxtaposed to each other. Each dielectric resonator B comprises a through-hole extended from an open-circuit end surface C to a short-circuit surface (not shown) of the dielectric substrate A and provided with a conductor layer D. In order to couple coaxial dielectric resonators B with each other, a conventional means can be used as by, for example, forming a hole E or a slit penetrating from the open-circuit end surface C to the short-circuit surface of the dielectric substrate A as shown in FIG. 1 or providing a counter-bore on the end portion of the formed coupling hole to enlarge the diameter of the portion.

With this kind of coupling, after the dielectric substrate is firstly formed to have a predetermined shape and inner and outer conductor layers are formed therein. Such a hole E or counter-bore should be formed at a high accuracy, with their widths and depths being decided, so that the production yield is low and difficulties are encountered in the manufacture of filters having equal characteristics. Further, the degree of coupling cannot be easily adjusted if it widely vary. In addition, there is another problem that the mechanical strength is deteriorated if the coupling hole is formed in the manner as stated above.

Meanwhile, in a case where a high frequency dielectric filter is adapted to telecommunications equipment such as portable wireless telephone or automobile telephone, it is often required that an attenuation pole should be provided at a frequency zone or position which is outside the intended frequency band and is apart from the center frequency by a predetermined frequency for isolating a transmitting signal from a receiving signal. To this ends, various arrangements have been attempted to satisfy this requirement. However, conventional means rely mainly on an external means such as a reactance element or the like for coupling coaxial dielectric resonators with each other and causes a problem in that the number of components is increased.

SUMMARY OF THE INVENTION

It is therefore an object of the present invention to provide a high frequency dielectric filter device having means by which coupling of coaxial dielectric resonators with each other and polarization thereof can be achieved easily and simultaneously.

According to the present invention there is provided a high frequency dielectric filter device having a dielectric substrate in which a plurality of through-holes are formed in parallel with each other, each of the through-holes has an inner surface provided with a conductor layer, an outer surface of the dielectric substrate is provided with an outer conductor layer which is connected with the inner conductor layers of the through-holes on one end surface of the dielectric substrate thereby to form a short-circuit surface, and the other end surface of the dielectric substrate has no conductor layer and forms an open-circuit end surface, wherein the outer surface of the dielectric substrate is provided with a portion having no conductor layer which extends in a direction traverse to the through-holes and is arranged close to the short-circuit end surface.

In general, in a conventional high frequency dielectric filter device having coaxial dielectric resonators each including a through-hole are connected with each other through an electric field on the side of an open-circuit end surface, and are connected with each other through a magnetic field on the side of a short-circuiting end surface.

With the high frequency dielectric filter device according to the present invention, however, since the portion having no conductor layer is formed to be extended in the direction traverse to the through-holes on the outer peripheral surface close to the short-circuit end surface, the magnetic field does not tend to spread away toward the outer conductor layer, thereby intensifying the coupling through the magnetic field. Therefore, the coupling of the resonators through the magnetic field as a whole is stronger than the coupling through the electric field, and the resonators adjacent to each other are coupled by the magnetic field, thereby forming inter-stage coupling.

Further, the coupling of the resonators through the magnetic field has a strength equal to the coupling through the electric field in the high band side of center frequency. Therefore, an attenuation pole is formed in the high band side of the center frequency.

With the high frequency dielectric filter device according to the present invention, the portion having no conductor layer on the outer surface of the dielectric substrate is provided by forming a slit extending in the widthwise direction on the outer surface of the dielectric substrate by means of a dicing saw or the like so as to remove the outer conductor layer thereon. Such a slit may also be formed simultaneous with the press-processing of the dielectric substrate. In that case, the outer conductor layer can be prevented from sticking to the inside of the slit, by applying the outer conductor layer only onto the circumferential outer surface of the dielectric substrate. In this way, the portion having no conductor layer may be provided on the outer surface of the dielectric substrate. Alternatively, the portion having no conductor layer may be formed by partially removing the outer conductor layer arranged on the outer surface of the dielectric substrate in a strip-like shape by means of laser-trimming, sand-blasting or the like. Further, the portion having no conductor layer may be formed on the top surface of the dielectric substrate by means of patterning according to a screen printing method or the like while the outer conductor layer is formed.

The present invention will now be described by way of example with reference to the accompanying drawings.

DETAILED DESCRIPTION

Figure 1:
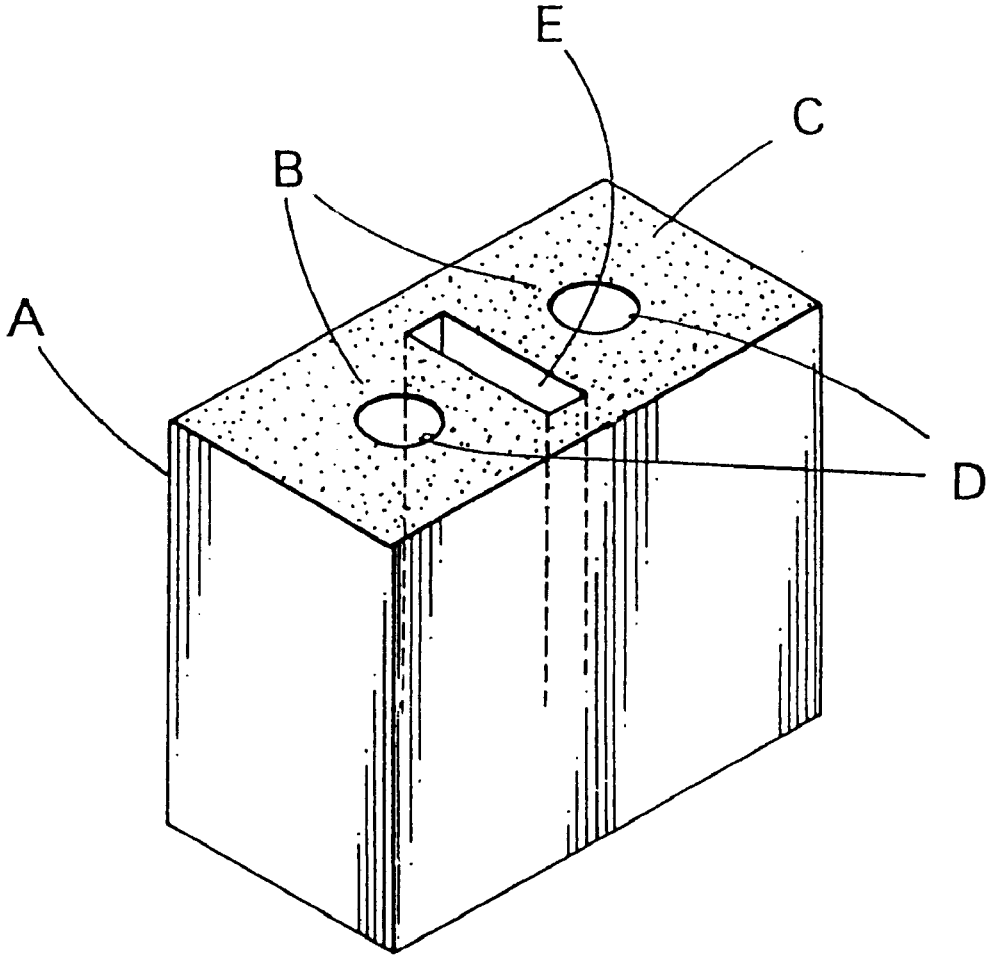
FIG. 1 (PRIOR ART)
FIG. 1 is a perspective view showing a conventional high frequency dielectric filter device.
Figure 2:
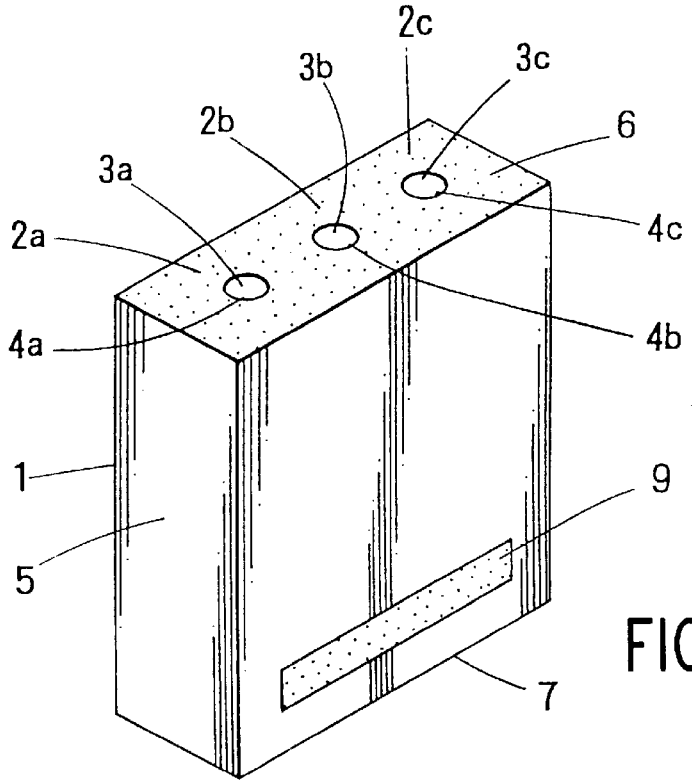
FIG. 2 a perspective view showing a three-stage type high frequency dielectric filter device according to one embodiment of the present invention.
Figure 3:
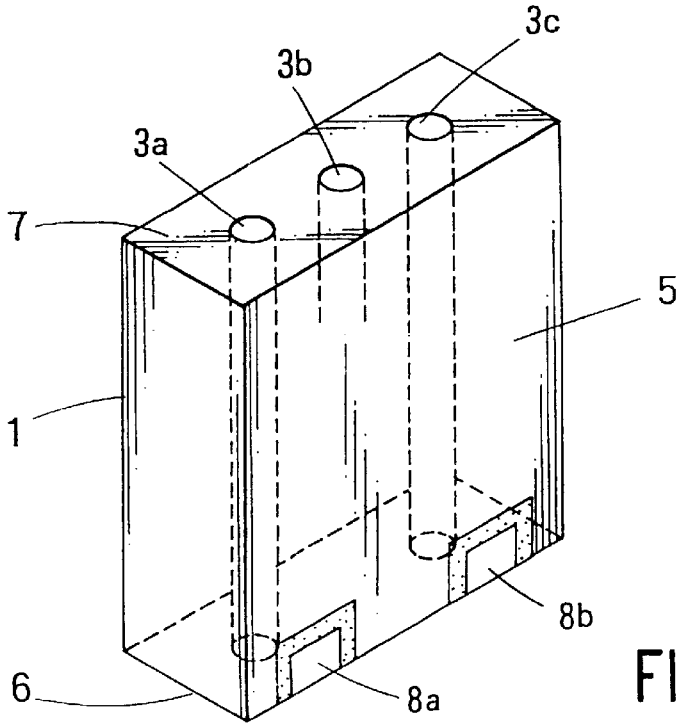
FIG. 3 is a perspective view showing the high frequency dielectric filter of FIG. 2 observed from the back side.

FIGS. 2 and 3 show a three-stage type high frequency dielectric filter according to one embodiment of the present invention in which a single dielectric substrate or block 1 is provided with three coaxial dielectric resonators 2*a*, 2*b* and 2*c* (see FIG. 2). The dielectric substrate 1 has a rectangular parallelepiped shape and is formed of a titanium-oxide based dielectric ceramic material. Three through-holes 3*a*, 3*b* and 3*c* are formed so as to define the respective coaxial dielectric resonators 2*a*, 2*b*, and 2*c*. Inner conductor layers 4*a*, 4*b* and 4*c* (see FIG. 2) are provided on the surfaces of the through-holes 3*a*, 3*b* and 3*c*, respectively. An outer conductor layer (or ground conductor) 5 is provided on the outer peripheral surface of the substrate 1 except the front end surface thereof. That is, the front end surface of the outer peripheral surface of the substrate 1 is not coated with the outer conductor layer 5 to form an open-circuit end surface 6, while the inner conductor layers 4*a*, 4*b* and 4*c* of the coaxial dielectric resonators 2*a*, 2*b* and 2*c* are connected to each other by the outer conductor layer 5 on the rear end surface of the substrate 1 which thus forms a short-circuit end surface 7.

On a bottom surface of the substrate 1 is provided input/output conductor members 8*a* and 8*b* each of which is insulated from the outer conductor layer 5 as shown in FIG. 3. The input/output conductor member 8*a* is capacitively connected with the inner conductor layer 4*a* of the the through-hole 3*a* through the dielectric substrate portion therebetween. In the same way, the input/output conductor member 8*b* is capacitively connected with the inner conductor layer 4*c* of the the through-hole 3*c* through the dielectric substrate portion therebetween. Further, one of the input/output conductor members 8*a* and 8*b* is connected with an input terminal of a desired electric circuit not shown, while the other input/output conductor member is connected with an output terminal of the electric circuit. Thus, electric connection of the high-frequency dielectric filter 1 is completed.

A main features of the present invention will be explained in the following.

As shown in FIG. 2, the outer surface or top surface of the dielectric substrate 1 is provided with a portion 9 which has no conductor thereon. This portion 9 may be formed by partially removing the outer conductor layer 5. The portion 9 is positioned close to the short-circuit end surface 7 and is arranged to be extended in a direction traverse to the through-holes 3*a*, 3*b* and 3*c*.

Figure 4:
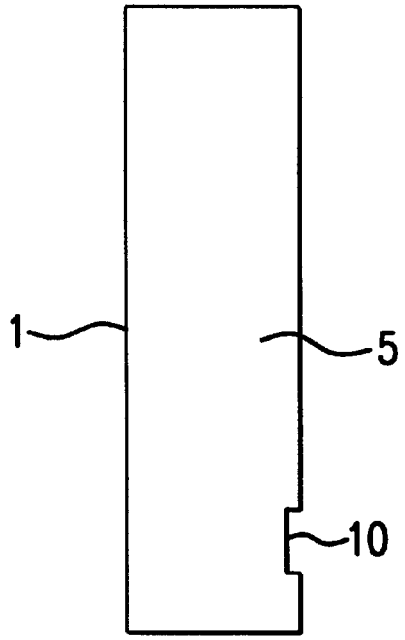
FIG. 4 is a side view showing how a portion having no conductor layer is formed on the outer surface of a dielectric substrate.
Figure 5:
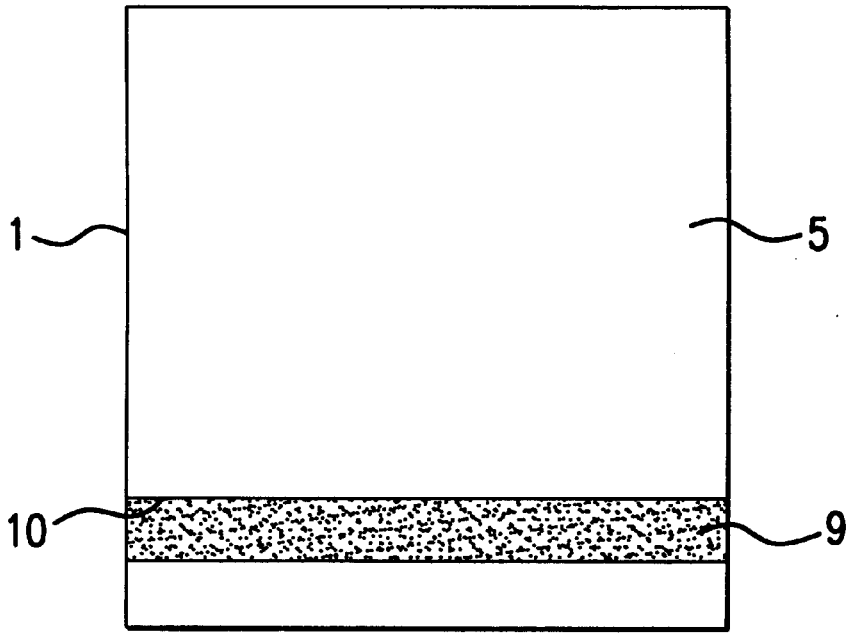
FIG. 5 is a plan view of the arrangement of FIG. 4.

FIGS. 4 and 5 show how the portion 9 of FIG. 2 having no conductor layer may be formed. The portion 9 (see FIG. 5) may be provided by forming a shallow slit 10 on the outer surface of the dielectric substrate 1 in the widthwise direction thereof by a dicing saw or the like so that the outer conductor layer 5 thereon is removed. Alternatively, the shallow slit 10 may be formed simultaneous with the shaping of the dielectric substrate 1 by means of press-processing, and then an outer conductor layer is provided on the outer surface of the substrate in such a way that no conductor layer is applied to the inside of the formed slit.

Figure 6:
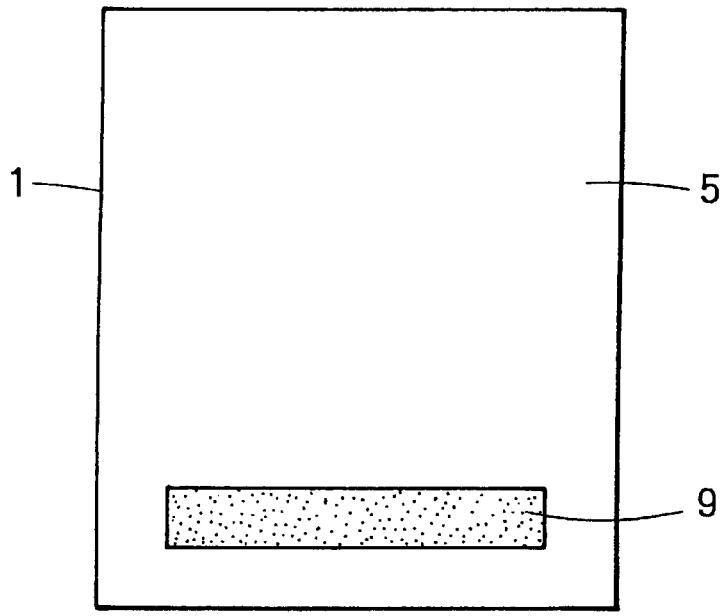
FIG. 6 is a plan view showing another method of forming a portion having no conductor layer on the outer surface of the dielectric substrate.

FIG. 6 shows another method of forming the portion 9 having no conductor layer in which the portion 9 may be formed by removing in a strip-like shape the outer conductor portion 5 provided on the outer surface of the substrate 1 by means of laser-trimming or sand-blasting.

Further, the portion 9 having no conductor layer may be formed simultaneous with the forming of the outer conductor layer 5 by means of pattering according to a screen printing method or the like. In this case, it is possible to form the portion 9 with an accurate shaping.

Figure 7A:
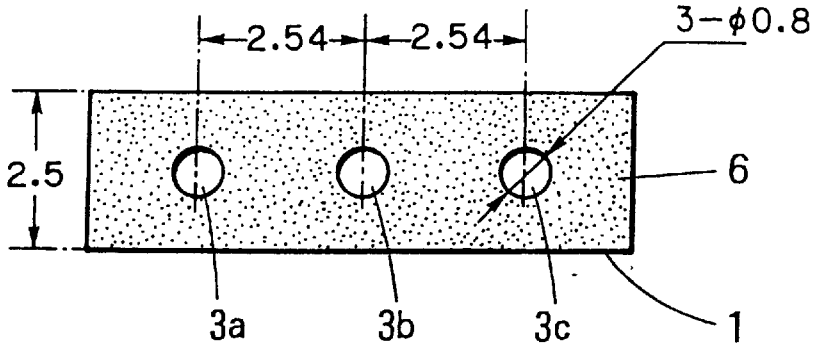
FIGS. 7(A) and 7(B) are views showing dimensions of a high frequency dielectric filter used in an experiment wherein 7(A) shows a front view and 7(B) shows a plan view.
Figure 7B:
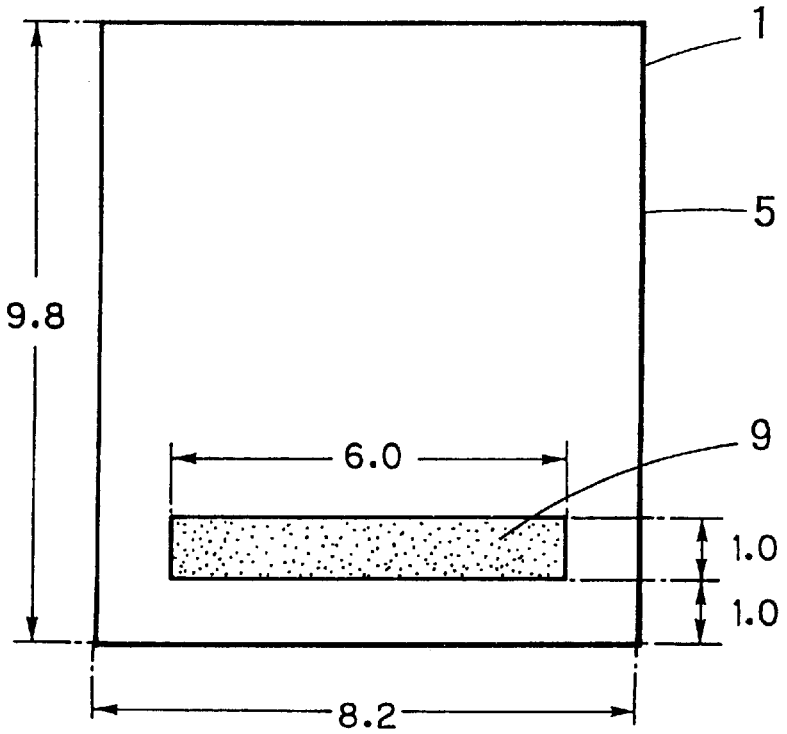

FIG. 7 shows dimensions of the high-frequency dielectric filter thus constructed with through holes 3*a*, 3*b* and 3*c*, ground conductor 5 and open-circuit end surface 6. As result of measurment it is appreciated that the high-frequency dielectric filter 1 having such dimensions has the following electric characteristics.

| | Intended Value | Measured Value |
|---|---|---|
| Center frequency $f_o$ | 836.5 MHz | 836.3 MHz |
| Bandwidth of 5 dB | greater than 25 MHz | 35.6 MHz |
| Current loss | less than 5 MHz | 2.79 dB |
| Attenuation at 804 MHz | greater than 10 dB | 13.5 dB |
| Attenuation at 869 MHz | greater than 20 dB | 32.6 dB |

Figure 8:
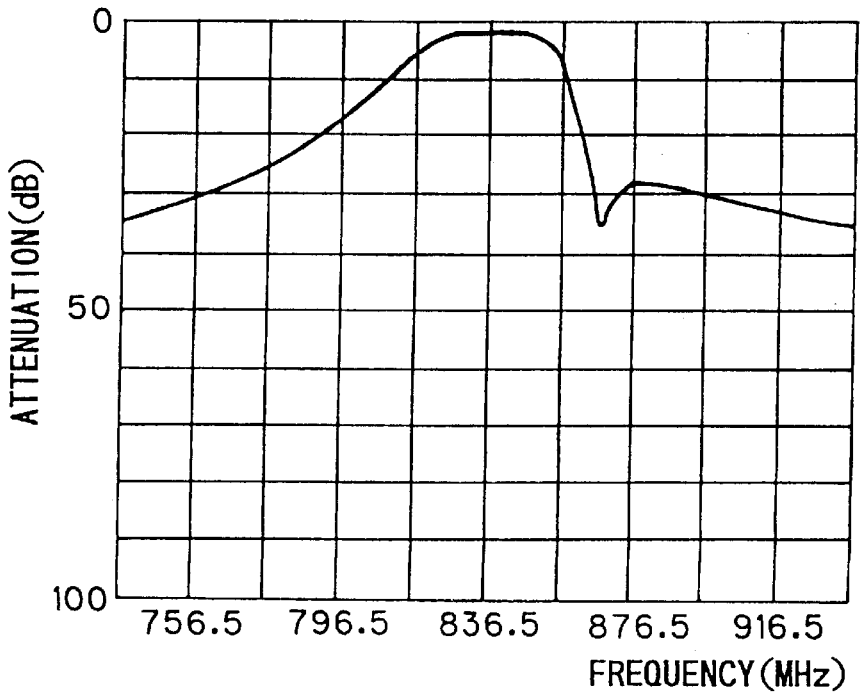
FIG. 8 is a graph showing a waveform of electric characteristics of the high frequency dielectric filter device according to the present invention.

FIG. 8 shows frequency characteristics of the filter. From this figure, it is appreciated that coaxial dielectric resonators 2*a*, 2*b* and 2*c* are combined and generate one single waveform.

From the above, it is apparent that since the portion 9 having no conductor layer is formed to be extended in a direction diagonal to the through-holes 3*a*, 3*b* and 3*c*, magnetic field coupling occurring at the short-circuit end surface 7 does not tend to spread away toward the outer conductor layer 5 but is intensified. Also apparently, the strength of the magnetic field coupling as a whole extends that of the electric field coupling, so that the resonators 2*a*, 2*b* and 2*c* are connected with each other by the magnetic field, and inter-stage coupling is obtained among these three stages.

Further, as shown in FIG. 8, an attenuation pole appears at a frequency of about 866 MHz. It is considered that the strength of the magnetic field coupling becomes equal to that of the electric field coupling at this frequency.

Figure 9:
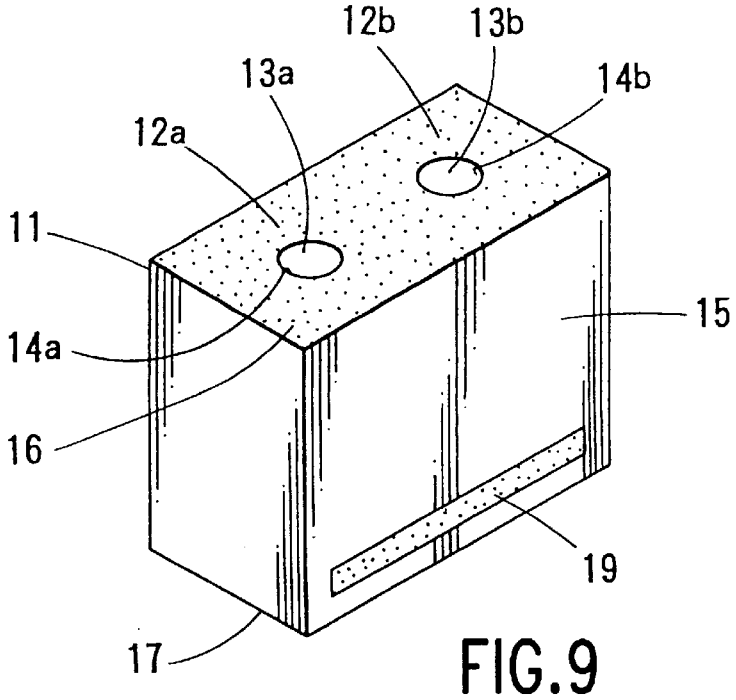
FIG. 9 is a perspective view showing a two-stage type high frequency dielectric filter device according to another embodiment of the present invention.
Figure 10:
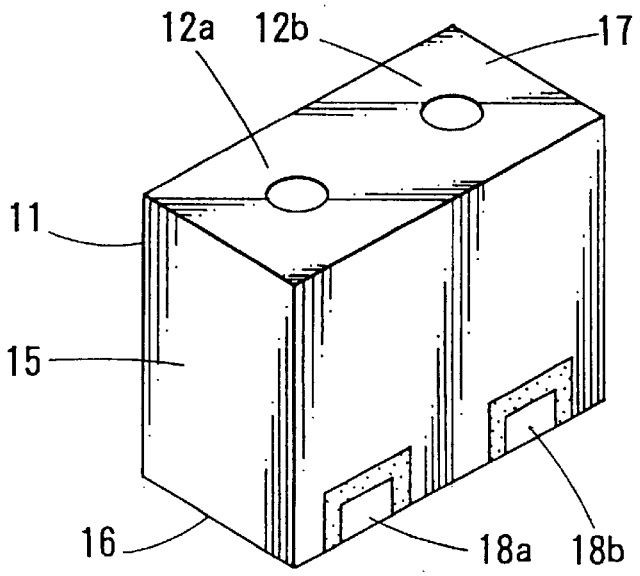
FIG. 10 is a perspective view showing the two-stage type high frequency dielectric filter device of FIG. 9 observed from the back side.

Although a three-stage type high frequency dielectric filter having coaxial dielectric resonators 2*a*, 2*b* and 2*c* has been explained in the above embodiment, the present invention may be applied to a two-stage type high frequency dielectric filter having two coaxial dielectric resonators 12*a* and 12*b*, as shown in FIGS. 9 and 10. In this arrangement two through-holes 13*a* and 13*b* are formed in a dielectric substrate 11 so as to define the respective coaxial dielectric resonators 12*a* and 2*b*. Inner conductor layers 14*a* and 14*b* (see FIG. 9) are provided on the surfaces of the through-holes 13*a* and 13*b* (see FIG. 9), respectively. An outer conductor layer (or ground conductor) 15 is provided on the outer peripheral surface of the substrate 11 except the front end surface thereof. That is, the front end surface of the outer peripheral surface of the substrate 11 is not coated with the outer conductor layer 15 to form an open-circuit end surface 16, while the inner conductor layers 14*a* and 14*b* of the coaxial dielectric resonators 12*a* and 12*b* are connected to each other by the outer conductor layer 15 on the rear end surface of the substrate 11 which thus forms a short-circuit end surface 17. On a bottom surface of the substrate 11 is provided input/output conductor members 18*a* and 18*b* (see FIG. 9) each of which is insulated from the outer conductor layer 15. As shown in FIG. 9, the outer surface or top surface of the dielectric substrate 11 is provided with a portion 19 which has no conductor layer. This portion 19 may be formed by partially removing the outer conductor layer 15. The portion 19 is positioned close to the shortcircuit end surface 17 and is arranged to be extended in a direction transverse to the through-holes 13*a* and 13*b*.

Furthermore, the present invention may be applied to a high frequency dielectric filter consisting of four or more stages.

In this arrangement, the characteristics (e.g., its frequency characteristic, attenuation pole forming frequency and the like) of the dielectric filter can be adjusted by controlling the position and area of the portion having no conductor layer. Therefore, if the characteristics need to be adjusted after once having formed a portion having no conductor layer, the characteristics can be easily adjusted by means of enlarging the portion having no conductor layer in the widthwise or longitudinal direction thereby to substantially change the position or area thereof or by means of additionally applying a conductor layer thereto.

In the present invention, since the portion having no conductor layer is formed on the outer peripheral surface close to the short-circuit end surface of the dielectric substrate in the direction diagonal to the through-holes, interstage coupling is obtained, and further, an attenuation pole is formed in the high band side of the center frequency.

Therefore, a coupling groove, a slit, a counter-bore or the like need not be formed by means of subjecting a dielectric block to post-processing, thereby resulting in an advantage of a high manufacturing yield. Further, an excellent advantage which contributes to stabilization of the characteristics of this kind of high frequency dielectric filter can be obtained in that the degree of coupling and the attenuation pole position can easily be adjusted by enlarging the portion having no conductor layer or additionally applying a conductor layer thereto, without deteriorating the mechanical strength.

What is claimed is:

1. A method of preparing a high frequency dielectric filter device comprising:

a dielectric substrate having two end surfaces, two lateral surfaces, a top surface and a bottom surface;

a plurality of resonators arranged in parallel with respect to each other, each resonator including a respective through-hole provided on the dielectric substrate and extended from one end surface to the other end surface of the dielectric substrate and an inner conductor layer provided on an inner surface of the through-hole, said one end surface of the dielectric substrate forming a short-circuited end surface, the other end surface forming an open-circuited end surface;

an outer conductor layer provided on the one end surface, the lateral surfaces, the top and bottom surfaces of the dielectric substrate, one end of the each inner conductor layer being connected to the outer conductor layer on the short-circuited end surface;

input/output pads arranged on the bottom surface of the dielectric substrate which is to be mounted on a printed circuit board; and a non-conductive portion provided on the top surface of the dielectric substrate for intensifying a coupling of the resonators through a magnetic field and forming an attenuation pole in a high band side of a center frequency, comprising simultaneously forming the non-conductive portion and the outer conductor by means of patterning according to a screen printing.

* * * * *